US008381879B2

(12) United States Patent
Griffin

(10) Patent No.: US 8,381,879 B2
(45) Date of Patent: Feb. 26, 2013

(54) DRIVE SYSTEMS AND CARGO LIFT SYSTEMS

(75) Inventor: William Bradley Griffin, LaGrange, NC (US)

(73) Assignee: Unifab, Inc., Snow Hill, NC (US)

( * ) Notice: Subject to any disclaimer, the term of this patent is extended or adjusted under 35 U.S.C. 154(b) by 1058 days.

(21) Appl. No.: 12/262,360

(22) Filed: Oct. 31, 2008

(65) Prior Publication Data

US 2010/0108446 A1 May 6, 2010

(51) Int. Cl.
*B66B 11/04* (2006.01)

(52) U.S. Cl. ..... 187/261; 254/362; 254/358

(58) Field of Classification Search ..... 187/261, 187/239, 267, 268, 401; 254/358, 362
See application file for complete search history.

(56) References Cited

U.S. PATENT DOCUMENTS

| | | | | | |
|---|---|---|---|---|---|
| 2,042,480 | A | * | 6/1936 | Patterson, Jr. | 254/345 |
| 3,034,767 | A | | 5/1962 | Gordon | |
| 4,004,780 | A | * | 1/1977 | Kuzarov | 254/345 |
| 4,469,198 | A | * | 9/1984 | Crump | 182/141 |
| 5,211,124 | A | | 5/1993 | Reiser | |
| 5,287,821 | A | | 2/1994 | Godbersen | |
| 5,549,180 | A | * | 8/1996 | Hansen | 187/347 |
| 5,772,360 | A | | 6/1998 | Wood, II | |
| 5,810,508 | A | | 9/1998 | Norfolk et al. | |
| 5,839,851 | A | * | 11/1998 | Norfolk et al. | 405/3 |
| 5,845,745 | A | * | 12/1998 | Lane | 187/259 |
| 5,941,347 | A | * | 8/1999 | Pfleger et al. | 187/234 |
| 5,957,623 | A | | 9/1999 | Sargent et al. | |
| 5,970,813 | A | | 10/1999 | Parkins et al. | |
| 6,021,692 | A | | 2/2000 | Norfolk et al. | |
| 6,033,148 | A | | 3/2000 | Norfolk et al. | |
| 6,122,994 | A | | 9/2000 | Norfolk et al. | |
| 6,397,691 | B1 | | 6/2002 | Greene | |
| 6,408,776 | B1 | | 6/2002 | McLaughlin et al. | |
| 6,435,768 | B1 | | 8/2002 | Mansfield | |
| 6,470,816 | B1 | | 10/2002 | Golden et al. | |
| 6,527,088 | B1 | * | 3/2003 | Fowler | 187/239 |
| 6,575,685 | B2 | * | 6/2003 | Baxter, Sr. | 414/10 |
| 6,640,934 | B1 | * | 11/2003 | Edwards | 187/239 |
| 7,117,805 | B2 | | 10/2006 | Schackelford, Jr. | |
| 7,383,781 | B1 | * | 6/2008 | Griffin | 114/44 |
| 2004/0035343 | A1 | | 2/2004 | Floe et al. | |
| 2005/0098387 | A1 | * | 5/2005 | Penn et al. | 187/262 |
| 2010/0108446 | A1 | * | 5/2010 | Griffin | 187/261 |

* cited by examiner

*Primary Examiner* — Michael Mansen
*Assistant Examiner* — Michael Riegelman
(74) *Attorney, Agent, or Firm* — Myers Bigel Sibley & Sajovec, PA

(57) ABSTRACT

A drive system for use with a cable and a carrier for raising and lowering a payload includes a reel, a drive mechanism, a cable slack control mechanism, and a tension adjustment system. The drive member is operatively connected to the reel to rotate the reel in a winding direction when the drive member is rotated in a raising direction, and to controllably rotate the reel and/or permit the reel to rotate in an unwinding direction when the drive member is rotated in a lowering direction. The cable slack control mechanism is operative to automatically selectively decouple the drive member from the reel while the drive motor is rotating the drive member in the lowering direction when a tension on the cable does not exceed a threshold tension and/or the cable is fully unwound from the reel. The tension adjustment system is operable to selectively adjust the threshold tension.

12 Claims, 15 Drawing Sheets

DRIVE SYSTEMS AND CARGO LIFT SYSTEMS

FIELD OF THE INVENTION

The present invention relates to cargo lift systems and, more particularly, power driven cargo lift systems.

BACKGROUND OF THE INVENTION

Cargo lift systems may be used to raise and lower cargo between the ground and/or elevated floors of a building such as a raised beach house. Certain known cargo lift systems include a mast that is secured to the ground and the building, and a carrier mounted on the mast to shuttle cargo up and down the mast. In some such cargo lift systems, a drive system including an electric motor and a reel is used to wind and unwind a cable, which is attached to the carrier, to raise and lower the carrier.

SUMMARY OF THE INVENTION

According to embodiments of the present invention, a drive system for use with a cable and a carrier for raising and lowering a payload between a lower position and an upper position, the carrier being configured to hold the payload, the cable being connected to the carrier, includes a reel, a drive mechanism, a cable slack control mechanism, and a tension adjustment system. The reel is configured to receive the cable. The reel is rotatable in each of a winding direction to wind the cable onto the reel to raise the carrier and an unwinding direction to unwind the cable from the reel to lower the carrier. The drive mechanism includes a drive member and a motor operable to forcibly rotate the drive member in each of a raising direction and a lowering direction. The drive member is operatively connected to the reel to rotate the reel in the winding direction when the drive member is rotated in the raising direction, and to controllably rotate the reel and/or permit the reel to rotate in the unwinding direction when the drive member is rotated in the lowering direction. The cable slack control mechanism is operative to automatically selectively decouple the drive member from the reel while the drive motor is rotating the drive member in the lowering direction when a tension on the cable does not exceed a threshold tension and/or the cable is fully unwound from the reel. The tension adjustment system is operable to selectively adjust the threshold tension.

According to embodiments of the present invention, a cargo lift system for raising and lowering a payload between a lower position and an upper position includes a carrier configured to hold the payload, a cable connected to the carrier, and a drive system. The drive system includes a reel, a drive mechanism, a cable slack control mechanism, and a tension adjustment system. The reel is connected to the cable. The reel is rotatable in each of a winding direction to wind the cable onto the reel to raise the carrier and an unwinding direction to unwind the cable from the reel to lower the carrier. The drive mechanism includes a drive member and a motor operable to forcibly rotate the drive member in each of a raising direction and a lowering direction. The drive member is operatively connected to the reel to rotate the reel in the winding direction when the drive member is rotated in the raising direction, and to controllably rotate the reel and/or permit the reel to rotate in the unwinding direction when the drive member is rotated in the lowering direction. The cable slack control mechanism is operative to automatically selectively decouple the drive member from the reel while the drive motor is rotating the drive member in the lowering direction when a tension on the cable does not exceed a threshold tension and/or the cable is fully unwound from the reel. The tension adjustment system is operable to selectively adjust the threshold tension.

According to embodiments of the present invention, a cargo lift system for raising and lowering a payload between a lower position and an upper position includes a mast, a carrier configured to hold the payload, a sleeve housing assembly, a cable and a drive system. The sleeve housing assembly includes a plurality of separately formed sleeve housing members fastened together to form a sleeve housing defining a sleeve housing passage. The sleeve housing is secured to the carrier and is slidably mounted on the mast such that the mast extends through the sleeve housing passage. The cable is connected to the sleeve housing. The drive system includes a reel and a drive mechanism. The reel is connected to the cable. The reel is rotatable in each of a winding direction to wind the cable onto the reel to raise the carrier along the mast and an unwinding direction to unwind the cable from the reel to lower the carrier along the mast. The drive mechanism includes a motor operable to forcibly rotate the reel in each of the winding direction and the unwinding direction.

According to embodiments of the present invention, a cargo lift system for raising and lowering a payload between a lower position and an upper position includes a carrier, a cable connected to the carrier, and a drive system. The carrier includes a carriage and a gate assembly. The carriage defines a payload region configured to hold the payload and an entrance opening to receive the payload into the payload region, the entrance opening having a left side and a right side. The gate assembly can selectively close the entrance opening. The gate assembly includes a gate member and a gate mounting system configured to mount the gate member on the carriage in each of a left side mount position, wherein the gate member is pivotable open about a left side hinge, and a right side mount position, wherein the gate member is pivotable open about a right side hinge. The drive system includes a reel and a drive mechanism. The reel is connected to the cable. The reel is rotatable in each of a winding direction to wind the cable onto the reel to raise the carrier and an unwinding direction to unwind the cable from the reel to lower the carrier. The drive mechanism includes a motor operable to forcibly rotate the reel in each of the winding direction and the unwinding direction.

According to embodiments of the present invention, a cargo lift system for raising and lowering a payload between a lower position and an upper position adjacent a support structure includes a mast system, a carrier, a sleeve housing, a cable and a drive system. The mast system includes a primary mast beam and a plurality of mounting beams selectively configurable in a plurality of alternative configurations to secure the primary mast beam to the support structure. The carrier is configured to hold the payload. The sleeve housing defines a sleeve housing passage. The sleeve housing is secured to the carrier and is slidably mounted on the primary mast beam such that the primary mast beam extends through the sleeve housing passage. The cable is connected to the sleeve housing. The drive system includes a reel and a drive mechanism. The reel is connected to the cable. The reel is rotatable in each of a winding direction to wind the cable onto the reel to raise the carrier along the primary mast beam and an unwinding direction to unwind the cable from the reel to lower the carrier along the primary mast beam. The drive mechanism includes a motor operable to forcibly rotate the reel in each of the winding direction and the unwinding direction.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
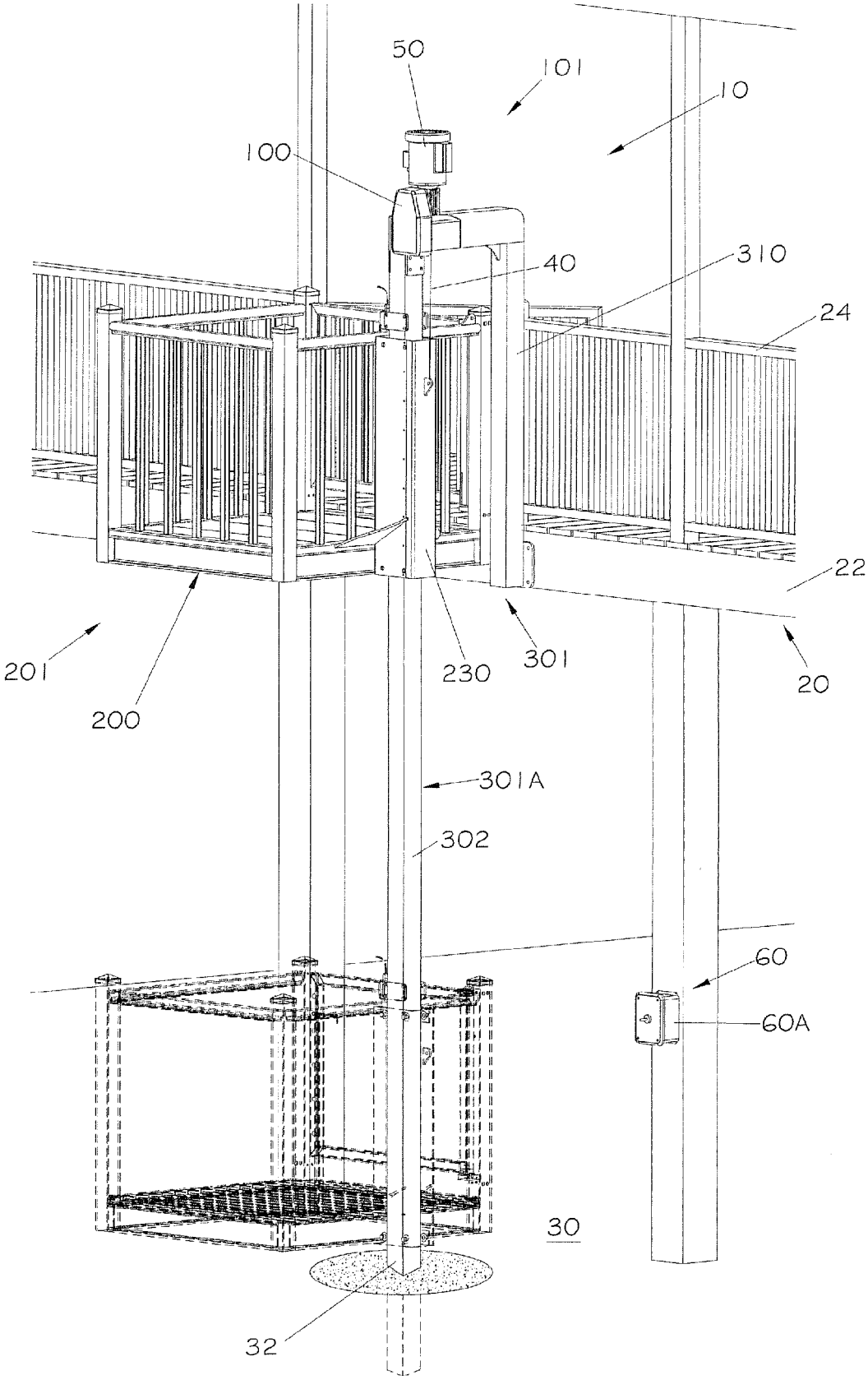
FIG. 1 is a perspective view of a cargo lift system according to embodiments of the present invention mounted on a building structure.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
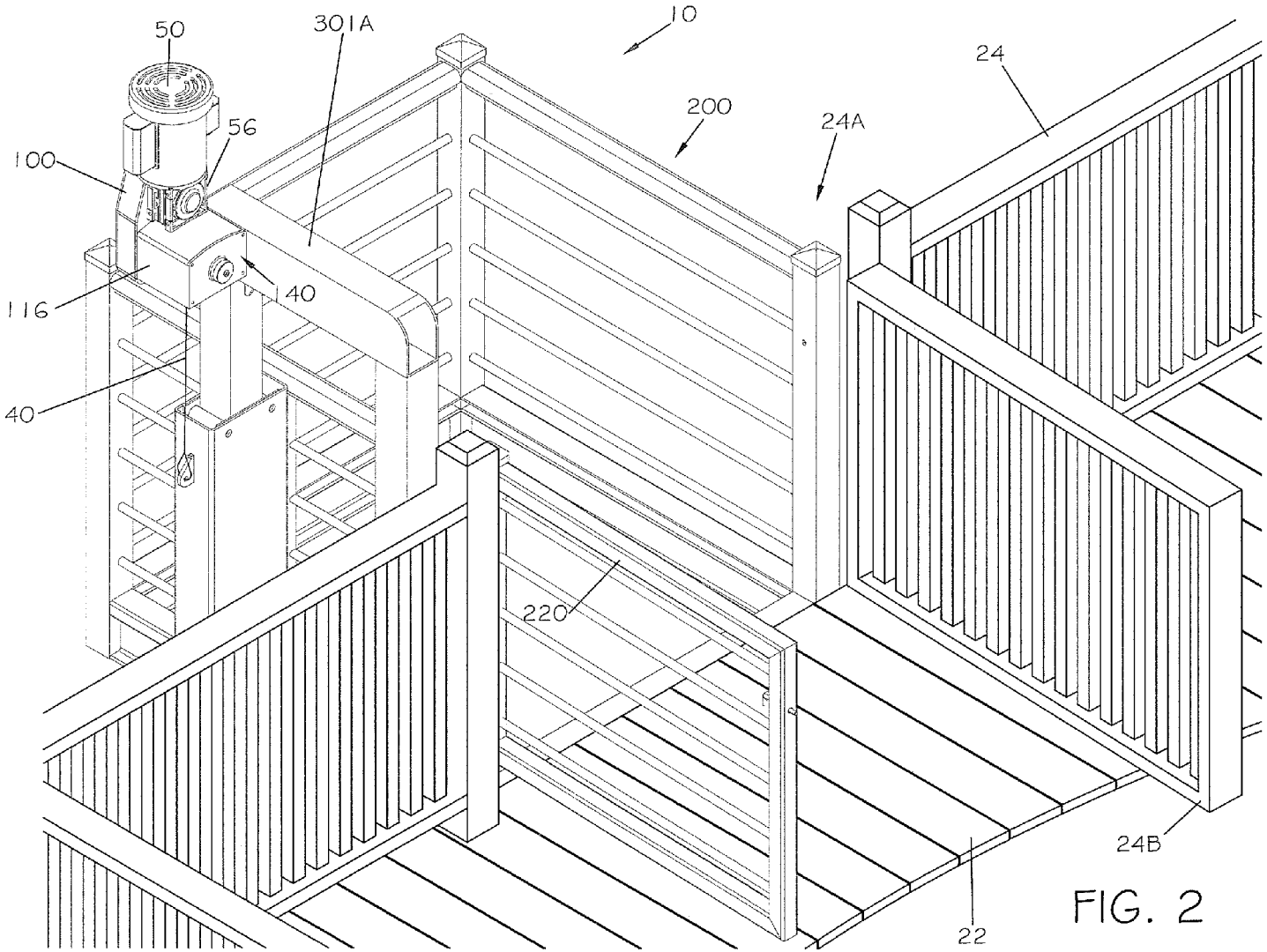
FIG. 2 is an enlarged perspective view of the cargo lift system of FIG. 1 on the building structure.

With reference to FIGS. 1 and 2, a cargo lift system 10 according to embodiments of the present invention is shown therein. The cargo lift system 10 may be used in conjunction with a structure or building 20 to selectively raise and lower cargo with respect to the building 20. The cargo lift system 10 includes a drive system 101, a carrier system 201, a mast system 301 and a cable 40. The carrier system 201 includes a carrier 200 for holding the cargo. The carrier 200 is slidably mounted on the mast system 301. Generally, the mast system 301 is mounted on the building 20 and the cable 40 is connected to the carrier 200 and the drive system 101 at either and thereof. The drive system 101 can be actuated to raise and lower the carrier 200 along the mast system 301.

The building 20 is merely exemplary and it will be appreciated that the cargo lift system 10 may be used with other types and configurations of buildings having raised floors. According to some embodiments, the building 20 is a residential building. The building 20 has a deck 22 at an elevation above the ground 30. A railing 24 surrounds the deck 22 and has an opening 24A (FIG. 2). A gate 24B (FIG. 2) can be provided in the railing 24.

Figure 6C:
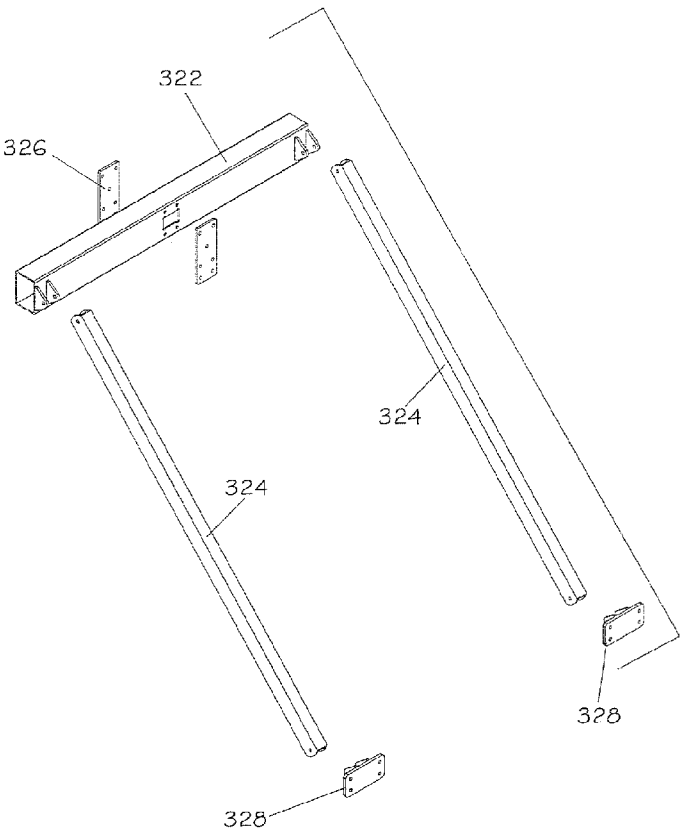
FIG. 6C is a perspective view of a U-shaped mounting mast beam of the cargo lift system of FIG. 1.
Figure 6B:
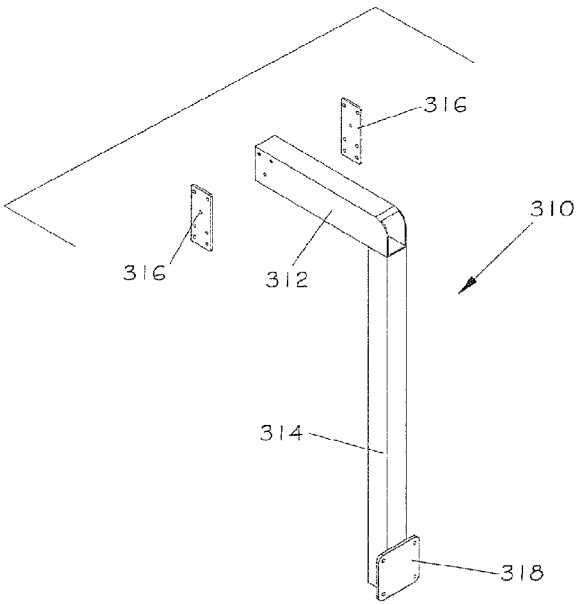
FIG. 6B is a perspective view of an L-shaped mounting mast beam of the cargo lift system of FIG. 1.
Figure 6A:
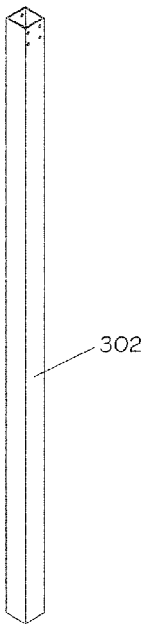
FIG. 6A is a perspective view of a primary mast beam of the cargo lift system of FIG. 1.
Figure 7:
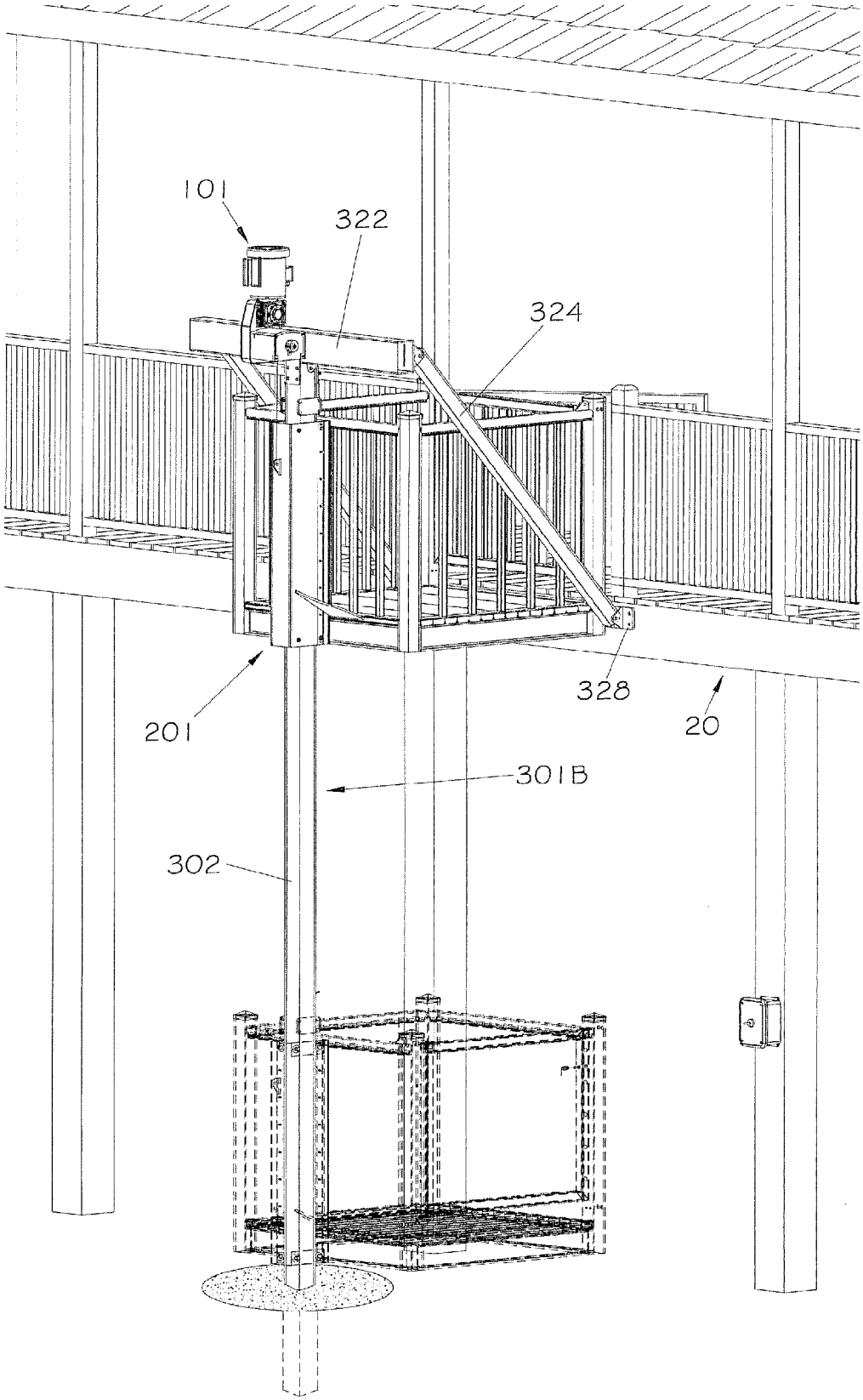
FIG. 7 is a perspective view of the cargo lift system of FIG. 1 mounted on the building structure with an alternative mast arrangement.

With reference to FIGS. 1 and 6B, the mast system 301 includes a primary mast beam 302 and an L-shaped mounting mast beam 310. Referring to FIG. 6B, the mast beam 310 has a cross leg 312, a brace leg 314, a pair of mast mount brackets 316 and a building mount bracket 318. As discussed herein with reference to FIGS. 6C, 7 and 8, the mast system 301 may include further or different components to enable different mast configurations.

A hole 32 is formed in the ground 30 and a lower section of the primary mast beam 302 is seated and secured in the hole 32 (e.g., using a concrete filler). The mast beam 310 is securely coupled to the primary mast beam 302 by the bracket 316 and to the building 20 by the bracket 318. In this manner, a sturdy, rigid mast assembly 301A is constructed. The mast assembly 301A has an inverted J-shape.

Figure 4:
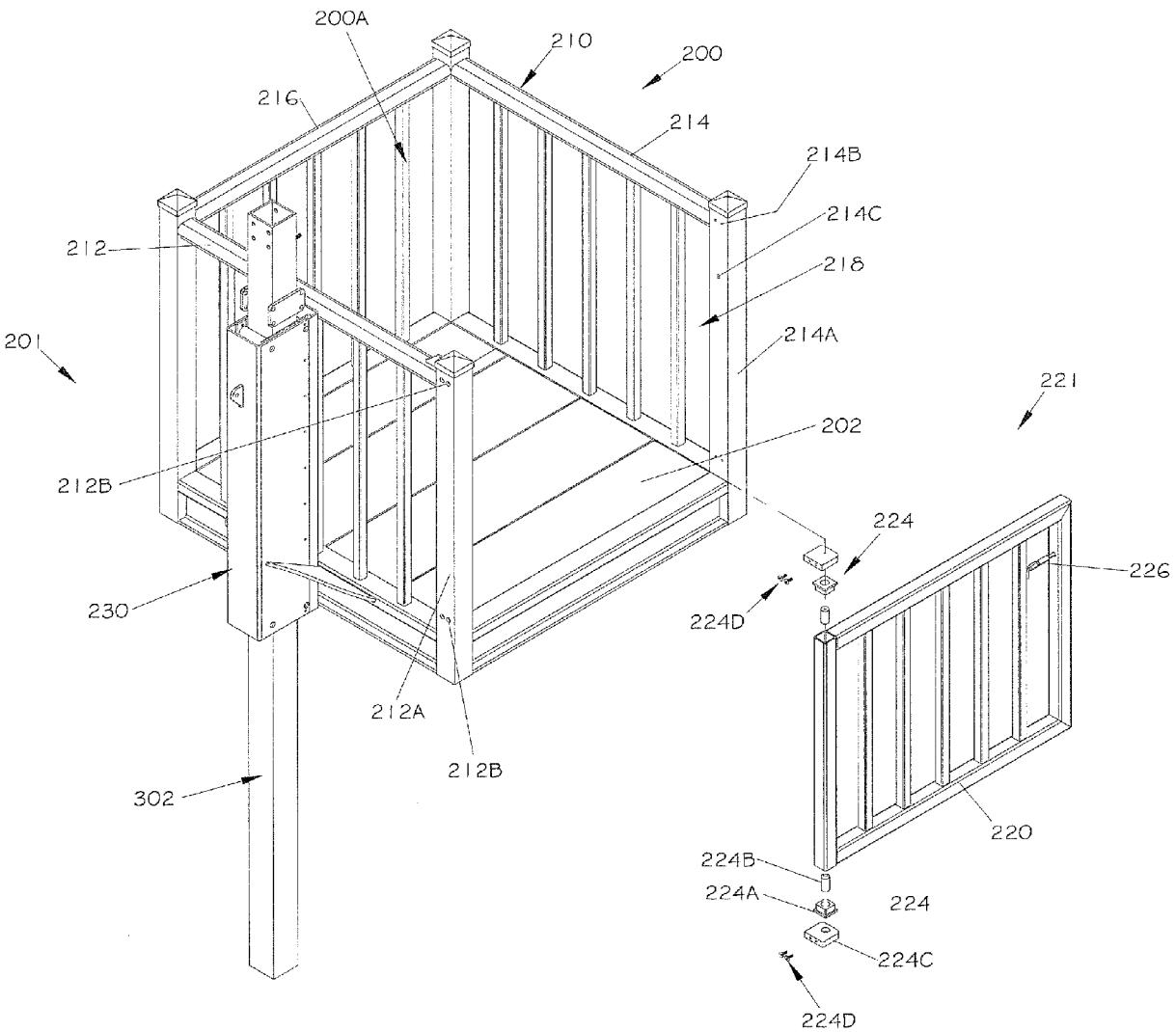
FIG. 4 is an enlarged, exploded, perspective view of the cargo lift system of FIG. 1 illustrating a gate system thereof in a left-side mounting arrangement.

As best seen in FIG. 4, the carrier system 201 includes the carrier 200 and a sleeve housing assembly 230. The carrier 200 includes a platform 202 surrounded by a rail assembly 210 and a gate system 221 to define a cargo containment area 200A.

The rail assembly 210 includes a left rail section 212, a right rail section 214 and a rear rail section 216. An access opening 218 is defined between a left post 212A of the rail section 212 and a right post 214A of the rail section 214.

The gate system 221 includes a gate section 220, hinge holes 212B, 214B formed in the posts 212A, 214A, gate latch holes 212C, 214C formed in the posts 212A, 214A, upper and lower hinge assemblies 224, and a latch mechanism 226. Each hinge assembly 224 includes a gate coupling member 224A seated in a hinge bore or slot of the gate section 220 and a post coupling member 224C pivotally connected to the gate coupling member 224A by a pivot bearing 224B. Each gate coupling member 224A is further affixed to the left post 212A by fasteners 224D, such as screws or bolts, inserted through the hinge holes 212B.

In use, the gate section 220 can be secured in a closed position as shown in FIG. 1 by seating a latch 226A (FIG. 5; e.g., a spring-loaded pin) of the latch mechanism 226 in the latch hole 214C. The user can retract the latch pin 226A from the latch hole 214C and pivot the gate section open about the post 212A to permit access to the cargo area 200A through the opening 218 as shown in FIG. 2. The gate section 220 can be closed using the reverse steps.

Figure 5:
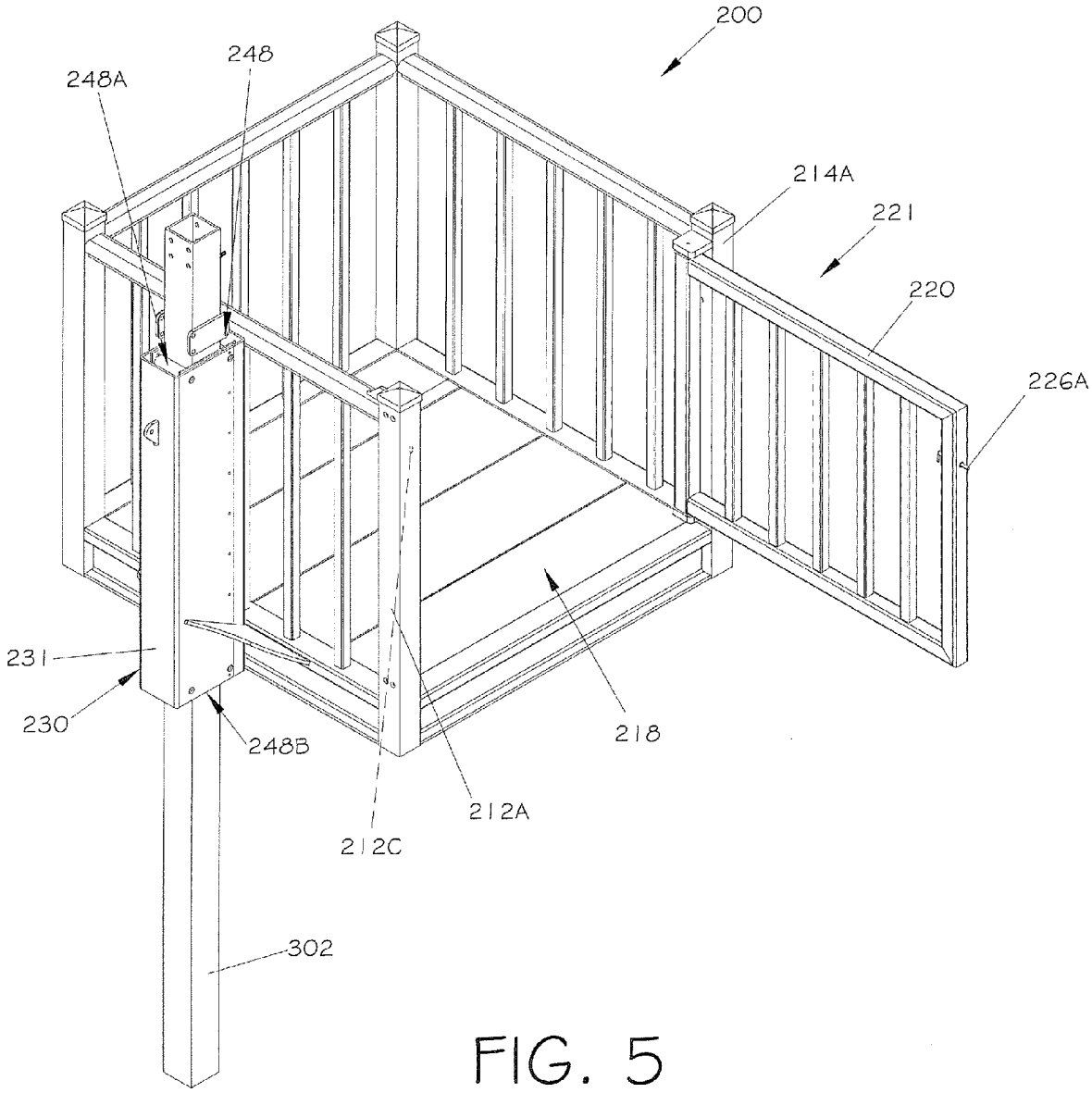
FIG. 5 is an enlarged, perspective view of the cargo lift system of FIG. 1 with the gate system in a right-side mounting arrangement.

The gate system 221 is also reversible, enabling the gate section 220 to be pivoted about the other post 214A as shown in FIG. 5. In order to achieve this configuration, the gate section 220 is reversed and the post coupling members 224C are secured to the post 214A by the fasteners 224D and the hinge holes 214B. The latch pin 226A is engaged with the latch hole 212C.

Figure 3:
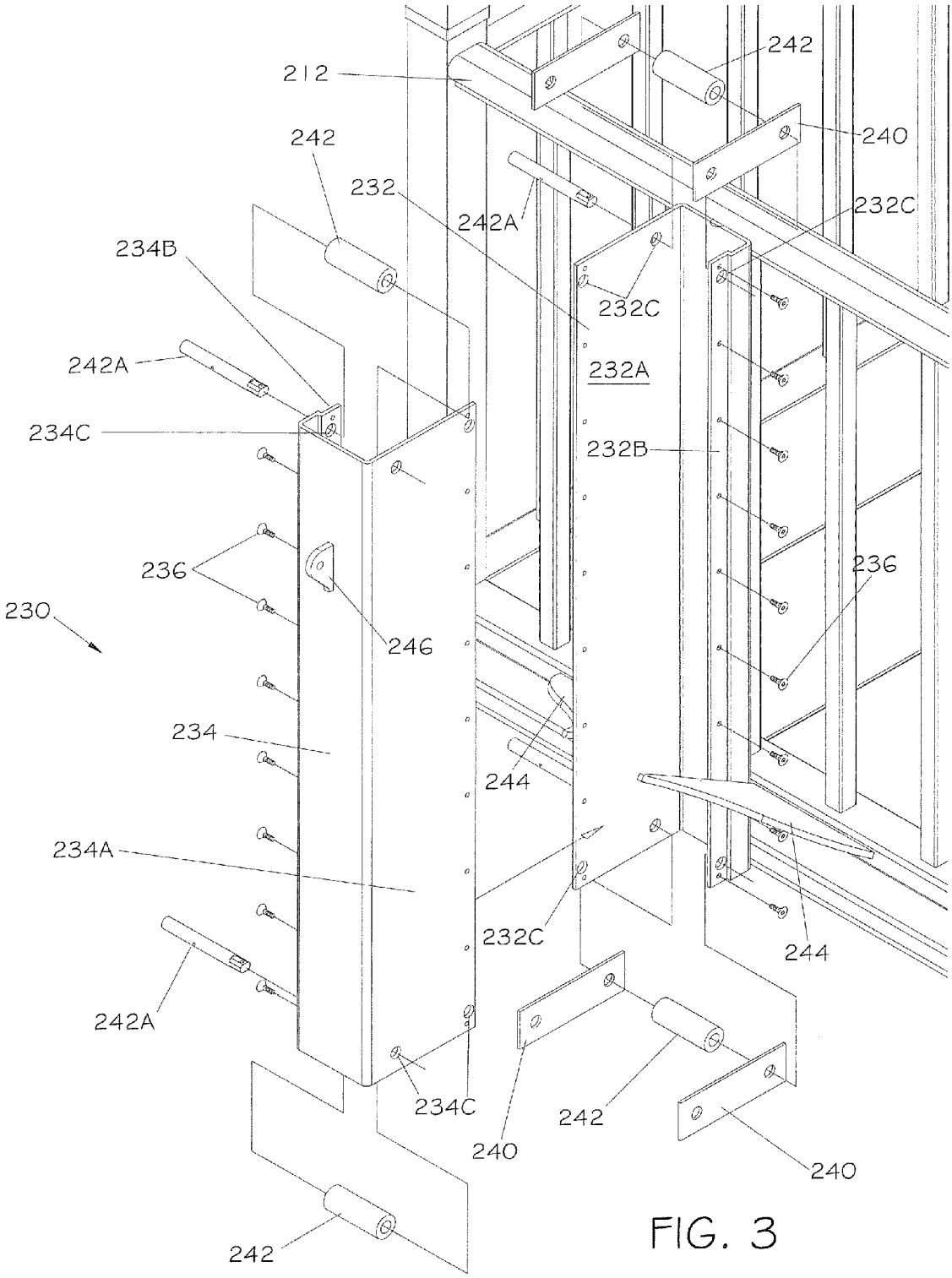
FIG. 3 is an enlarged, exploded, perspective view of the cargo lift system of FIG. 1 illustrating a sleeve housing assembly thereof.

With reference to FIGS. 3 and 5, the sleeve housing assembly 230 includes a sleeve housing 231, four rollers 242, four roller pins 242A, structural reinforcement or brace gussets 244, and a cable connector tab 246. The housing 231 is tubular and defines a through passage 248 (FIG. 5) and opposed openings 248A, 248B communicating with the passage 248.

The sleeve housing 231 includes an inner housing member 232 and an outer housing member 234. Each housing member 232, 234 is substantially J-shaped in cross-section and includes a respective major flange 232A, 234A and a respective minor flange 232B, 234B. Fastener holes 238 are defined in the flanges 232A, 232B, 234A, 234B. To assemble the sleeve housing 231, the housing members 232, 234 are mated such that the major flange 232A overlaps and engages the minor flange 234B and the major flange 234A overlaps and engages the minor flange 232B. The housing members 232, 234 are secured together using the fasteners 236.

The rollers 242 are rotatably secured in the passage 248 by roller pins 242A. Bearing or spacer plates 240 are interposed between the rollers 242 and the sleeve housing 231. The ends of the roller pins 242A are seated in mount holes 232C, 234C in the housing members 232, 234.

The sleeve housing 231 can be affixed to the carrier 200 by any suitable technique such as welding and/or fasteners. To improve rigidity, including lateral stability, the gussets 244 are secured to each of the sleeve housing 231 and the carrier 220.

The cable tab 246 is used to anchor an end of the cable 40 to the housing 231. The cable tab 246 may be an eyelet welded onto the sleeve housing 231, for example.

The carrier 200 is mounted on the primary mast beam 302 such that the primary mast beam 302 extends through the passage 248 of the sleeve housing 231. The sleeve housing 231 can slide freely or translate up and down the length of the primary mast beam 302. This movement is facilitated by the rollers 242, which engage the primary mast beam 302.

The drive system 101 includes a drive unit 100, a motor 50, a gear reducer 56 and a control unit 60 (FIG. 1). The drive unit 100 is mounted (e.g., by bolts) on the mast system 301. The gear reducer 56 is mounted (e.g., by bolts) on the drive unit 100, and the motor 50 is in turn mounted (e.g., by bolts) on the gear reducer 56. The control unit 60 is operable to control the motor 50. The control unit 60 may include a wireless transmitter unit 60A (FIG. 1) and a wireless receiver unit (not shown) or may be hardwired.

The drive unit 100 has a drive shaft 130 that is coupled to a reel 132. Generally, in use, the motor 50 can be selectively actuated to drive the drive unit 100, which in turn rotates the reel 132 in a given direction. The motor 50 may be a reversible motor so that the reel 132 can be selectively rotated in each of two alternative directions, such as a clockwise direction and a counterclockwise direction. In the illustrated embodiment, when the reel 132 is rotated in the counterclockwise (winding) direction (from the perspective of FIG. 12), the cable 40 will be wound onto and about the reel 132. When the reel 132 is rotated in the clockwise (unwinding) direction (from the perspective of FIG. 12), the cable 40 will be unwound from the reel 132. In this way, the carrier 200 can be raised and lowered.

A problem may occur in known cargo lifts using cables wound on reels. Namely, when lowering the carrier, the carrier may strike the ground or bottom G and the motor may continue to operate. As a result, the reel continues to rotate, causing slack to occur in the cable. The slacked cable may in turn tend to lift off the reel, which may cause mismatch between the cable and the reel, tangling of the cable, etc. Moreover, if the cable is fully unwound, continued rotation of the reel may cause the cable to reverse wind about the reel, which may likewise cause damage and inconvenience.

Cargo lifts according to embodiments of the present invention can prevent or inhibit occurrence of the foregoing problems. The drive unit 100 includes a clutch or cable slack control mechanism 150, as described in more detail below. The cargo lift system 10 is adapted such that when the carrier 200 is being lowered and the cable 40 becomes untensioned, the cable slack control mechanism 150 will decouple the reel 132 from the output of the motor 50 such that the reel 132 is no longer forcibly rotated in the unwinding direction. According to some embodiments, the cable slack control mechanism will decouple the reel 132 from the output of the motor 50 automatically (i.e., without requiring further action or intervention by the operator).

Figure 10:
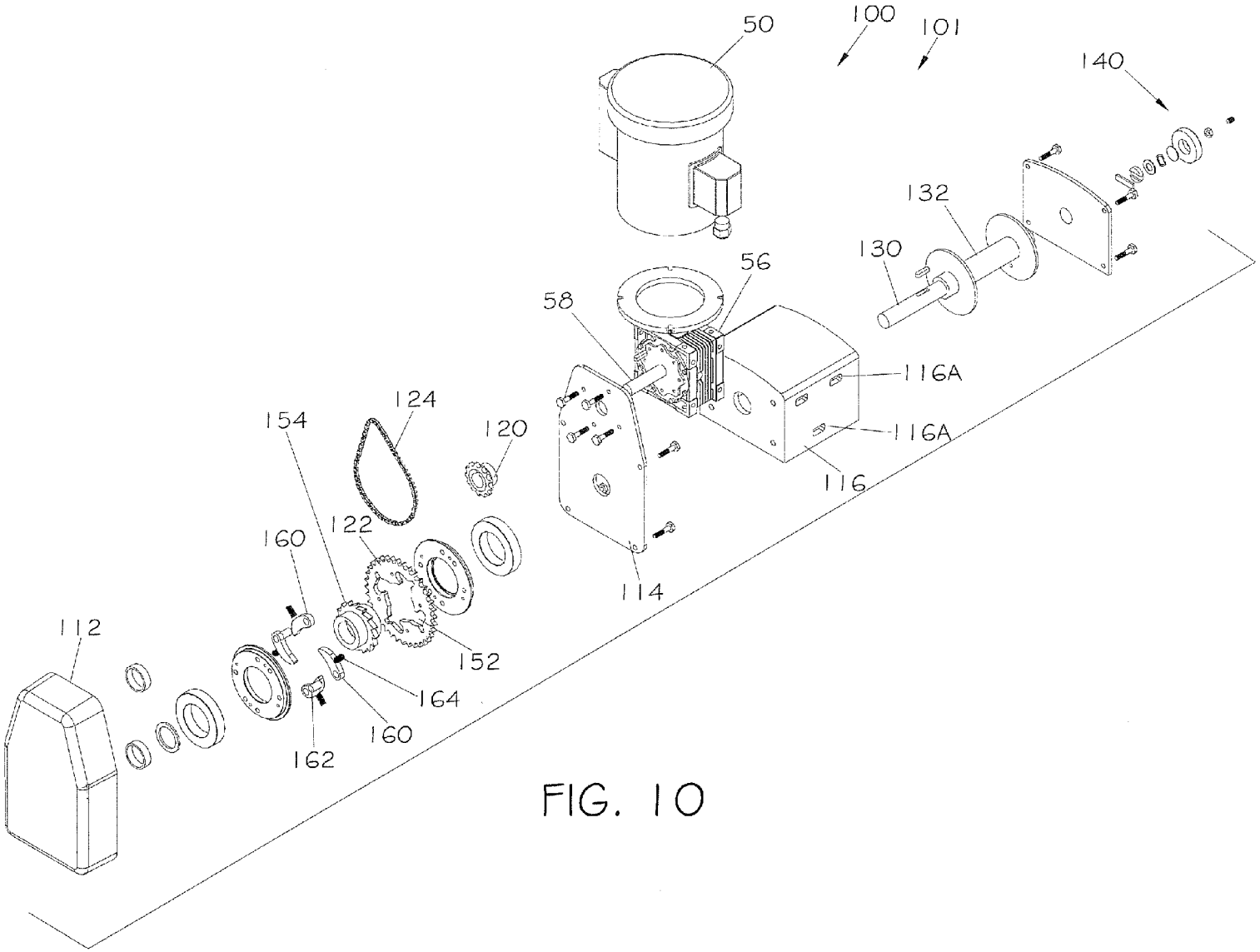
FIG. 10 is an exploded, front perspective view of the drive system of FIG. 9.
Figure 11:
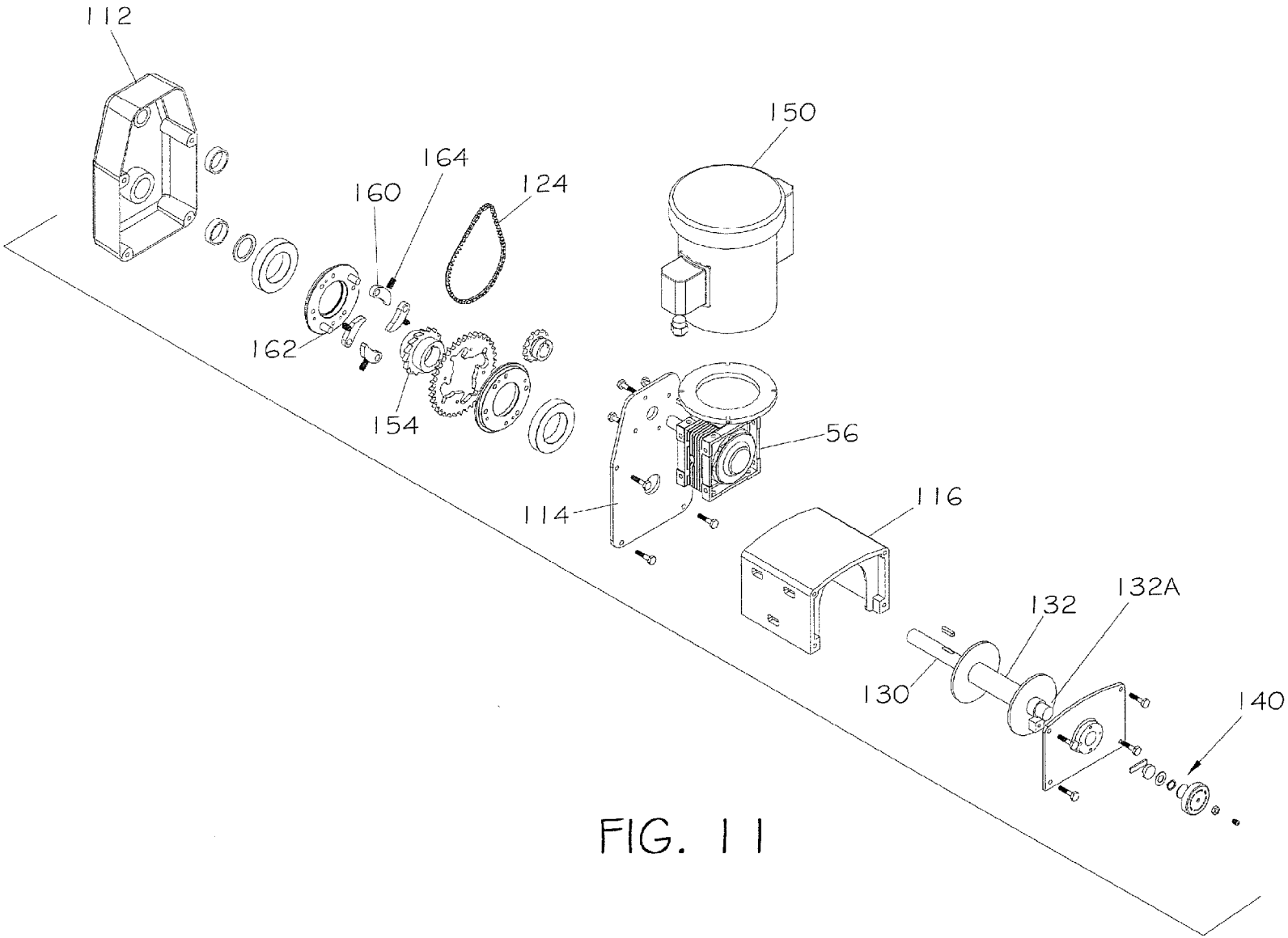
FIG. 11 is an exploded, rear perspective view of the drive system of FIG. 9.
Figure 12:
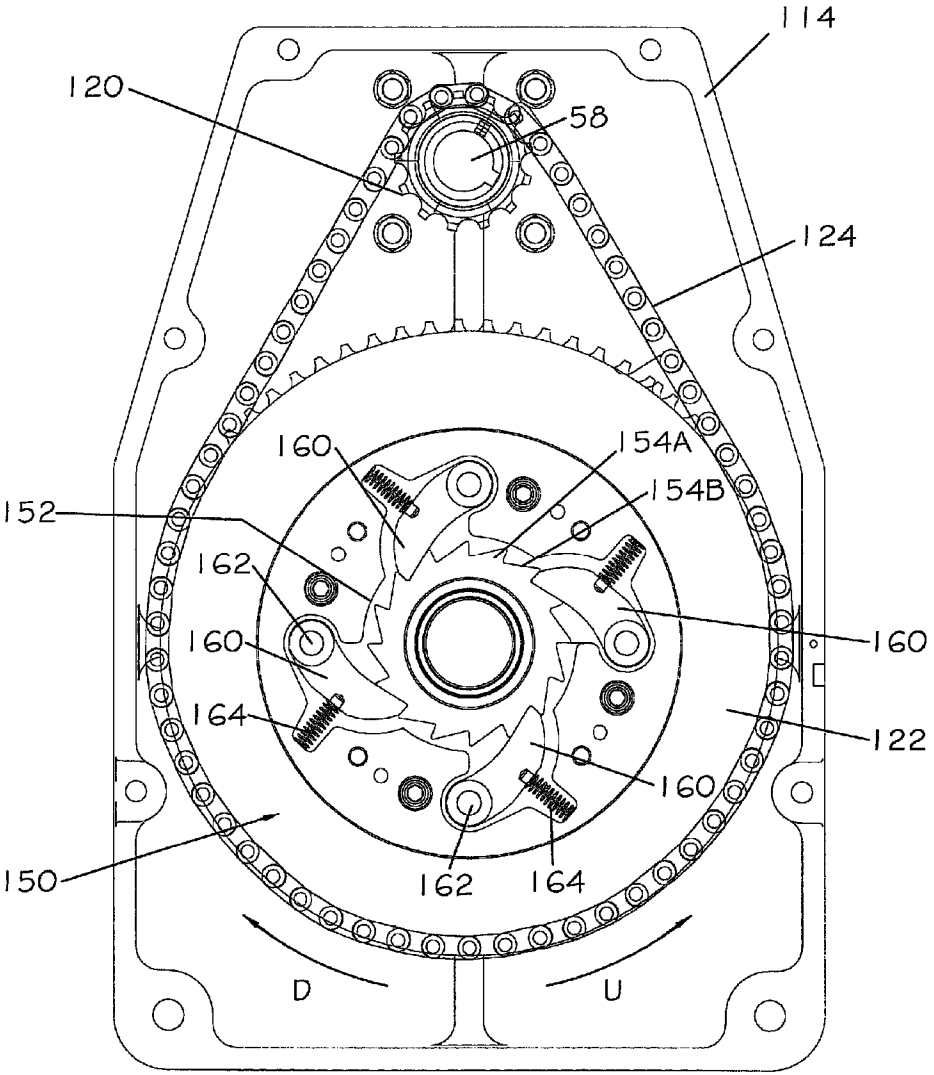
FIG. 12 is an enlarged, plan view of a drive unit of the drive system of FIG. 9 with a front cover member thereof removed.
Figure 13:
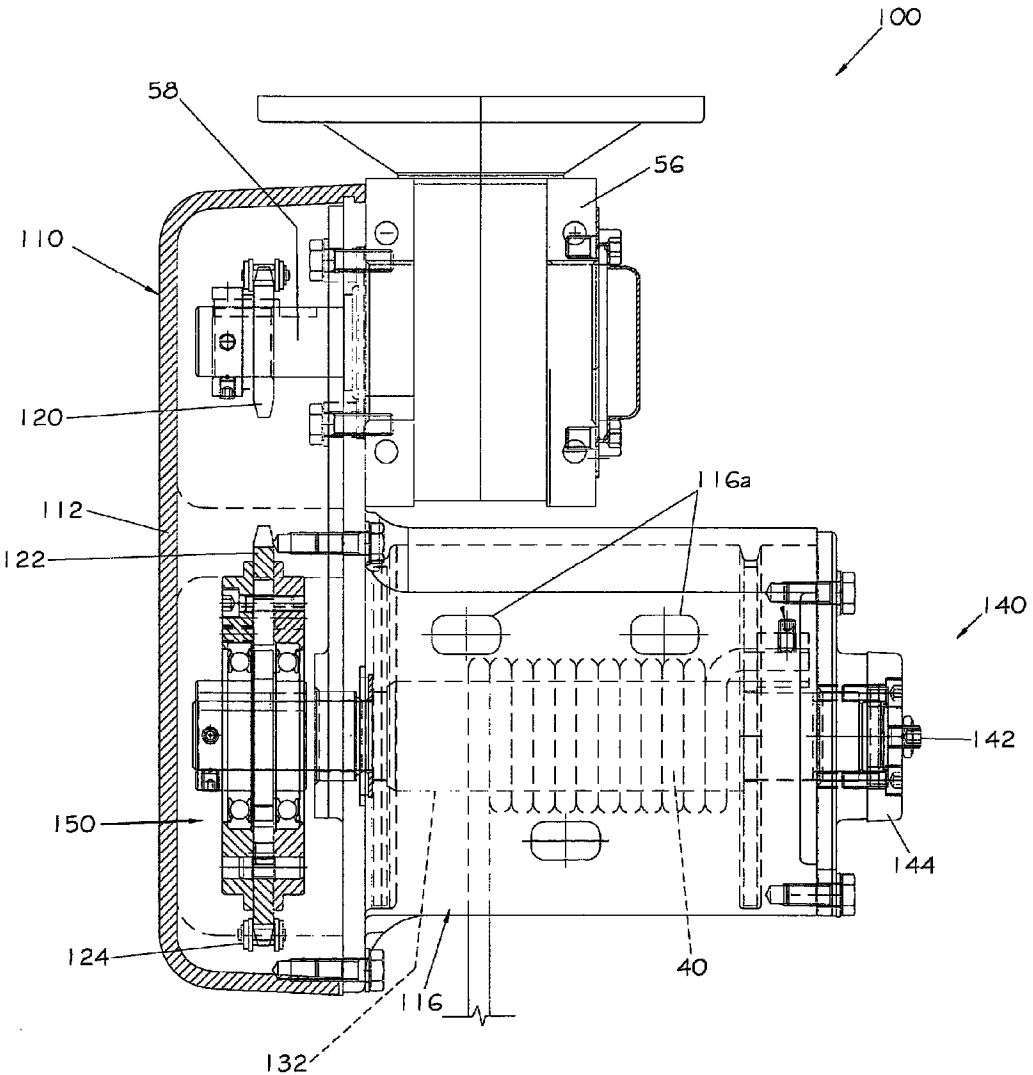
FIG. 13 is a cross-sectional side view of the drive system of FIG. 9.

Referring to FIGS. 10-12, the gear reducer 56 has an output shaft 58 that is driven by the motor 50. The output shaft 58 extends through a housing 110 (which includes a front housing member 112, a rear housing member 114, and a reel shroud 116) and drives a drive sprocket 120 therein. It will be appreciated that other arrangements can be employed for transmitting the force from the motor 50 to the sprocket 120. The sprocket 120 in turn drives a larger driven sprocket 122 via a chain 124. An inner control sprocket 154 is positioned in an opening 152 defined in the larger sprocket 122. The drive shaft 130 is affixed to the inner sprocket 154 and extends out of the housing 110. The drive shaft 130 is coupled to the reel 132 to impart rotation thereto. More particularly, the reel 132 is mounted on the drive shaft 130 for rotation therewith. The reel 132 is integrated into the drive unit 100 and is partially surrounded by the shroud 116. The drive unit 100 may be secured to the mast system 101 by fasteners (e.g., bolts) extending through mount holes 116A in the shroud 116.

The cable slack control mechanism 150 includes the inner sprocket 154 as well as four pawls 160. The pawls 160 are pivotably coupled to the large sprocket 122 by pivot pins 162 and are biased inward (i.e., toward the sprocket 154) by springs 164. The free ends of the pawls 160 are adapted to engage directional teeth 154A of the inner sprocket 154. The numbers, configurations and arrangements of pawls and teeth may differ from those illustrated.

In use, to raise the carrier 200, the motor 50 is actuated to rotate the motor output shaft 58 counterclockwise (from the vantage of FIG. 12). The larger sprocket 122 is thereby rotated in a counterclockwise direction U. The pawls 160 are firmly nested in the directional valleys 154B between the teeth 154A of the inner sprocket 154. Therefore, the drive force from the larger sprocket 122 can be reliably and efficiently transmitted to the inner sprocket 154, which turns the reel 132 to wind up the cable 40.

Once stopped in position, the weight of the carrier 200 (and its contents, if any) will apply a tensioning load to the cable 40. This load will apply a rotational load to the reel 132 in the clockwise direction. However, the engagement between the pawls 160 and the inner sprocket 154 will prevent the reel 132 from rotating clockwise so long as the motor 50 is not actuated.

When the user wishes to lower the carrier 200, the motor 50 is actuated to rotate the output shaft 58 in the clockwise direction. This in turn rotates the larger sprocket 122 in a clockwise direction D, which permits the inner sprocket 154, and thus the reel 132, to rotate in the clockwise direction. The motor 50 will thus permit the cable 40 to unwind from the reel 132 to controllably lower the carrier 200.

If and when the carrier 200 strikes the bottom or ground 30 (or other support surface such as a platform), the tension in the cable 40 is thereby removed (i.e., substantially reduced to zero or less). As a result, the clockwise rotational force on the reel 132 from the cable tension will also be removed and will no longer cause the teeth 154A of the inner sprocket 154 to bear against the pawls 160. Rather, the driven larger sprocket 122 will spin freely about the inner sprocket 154. The spring-biased pawls 160 will spin about the inner sprocket 154. While the bias from the springs 164 will cause the pawls 160 to follow the profile of the inner sprocket 154, the pawls 160 will not significantly transmit rotational force from the larger sprocket 122 to the inner sprocket 154. In this manner, the reel 132 is automatically selectively decoupled from the larger sprocket 122 and the motor 50 to prevent or inhibit over-rotation of the reel 132.

The cable slack control mechanism 150 will likewise automatically selectively decouple the reel 132 from the larger sprocket 122 in the event the cable 40 is fully unwound from the reel 132 without striking bottom. In this manner, the cable slack control mechanism 150 prevents or inhibits the cable 40 from being reverse wound onto the reel 132 (i.e., wrapping about the reel 132 in a direction counter to the original winding direction). Such decoupling may occur even if the tension is not removed from the cable 40.

When the direction of the motor 50 is again reversed, the pawls 160 will again securely engage the inner sprocket 154 to again raise the carrier 200.

Accordingly, the cable slack control mechanism 150 may serve as a one-way clutch mechanism that permits and enables normal functionality and operation while preventing or inhibiting a slack-induced failure mode.

According to some embodiments and as illustrated, the cable slack control mechanism 150 and the reel 132 are housed in a modular drive unit housing 110. Furthermore, according to some embodiments, the drive unit 100 can be modularly attached to and detached from the mast system 301. A mounting arrangement according to some embodiments is illustrated in FIG. 2. The drive unit 100 is secured to the mast system 301 by bolts that extend through holes 116A in the reel shroud 116.

According to some embodiments, the cable slack control mechanism 150 will decouple the motor 50 from the reel 132 if and when the tension in the cable 40 (e.g, due to gravity) is zero or less. However, it is also contemplated that the cable slack control mechanism may be configured to decouple the motor from the reel if and when the tension in the cable does not exceed some other prescribed threshold tension.

Figure 14:
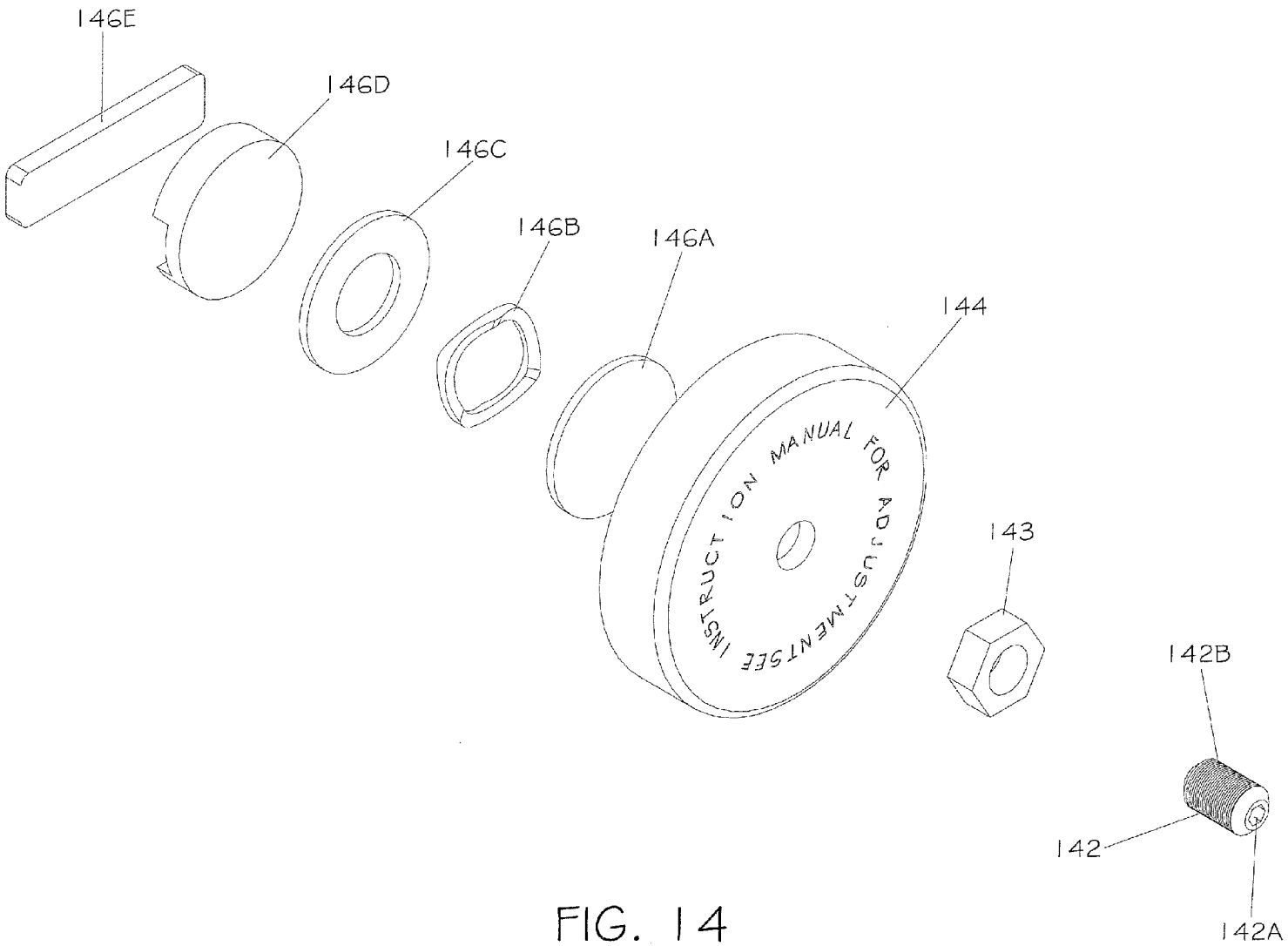
FIG. 14 is an enlarged, exploded, perspective view of a tension adjustment system of the drive system of FIG. 9.
Figure 15:
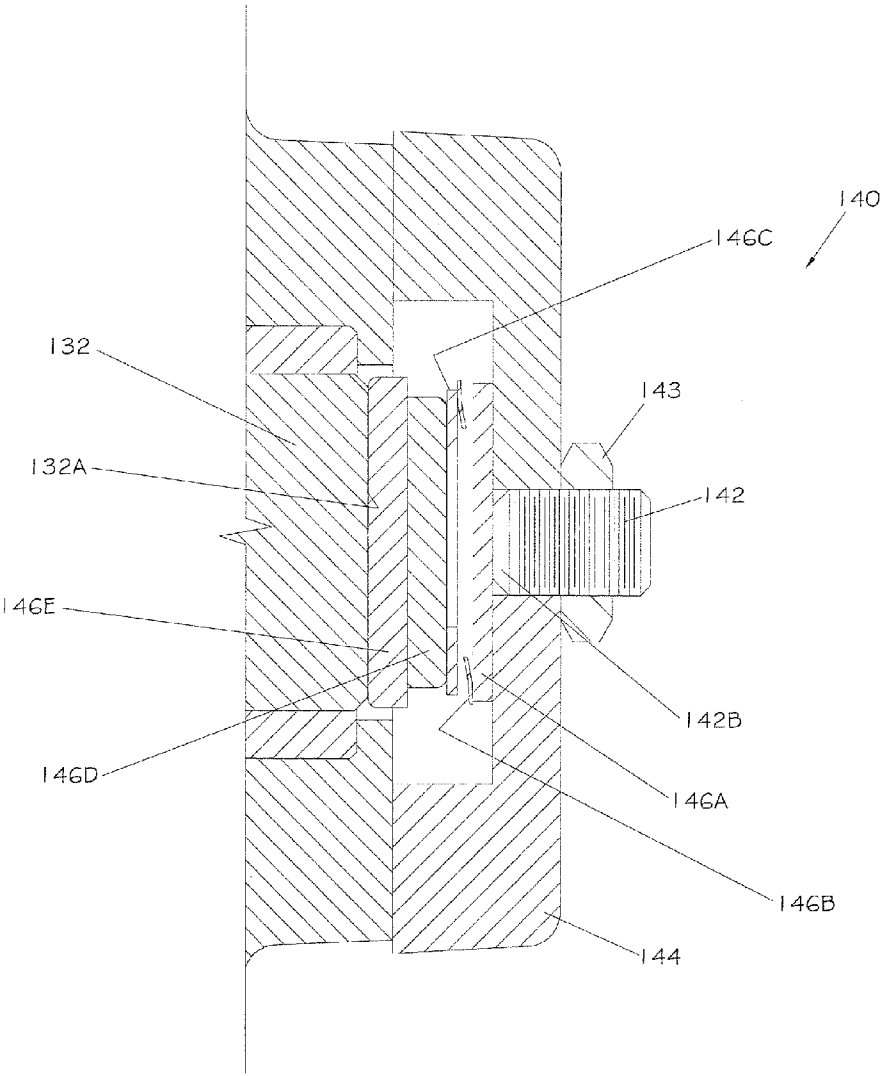
FIG. 15 is an enlarged, fragmentary, cross-sectional view of the tension adjustment system of FIG. 14.

According to some embodiments, the drive unit 100 includes a trigger or tension adjustment system 140 operable to selectively adjust the threshold tension (i.e., the tension on the cable that, when exceeded, will cause the cable slack control mechanism 150 to automatically decouple the reel 132 from the larger sprocket 122). Referring to FIGS. 9-11, 14 and 15, the tension adjustment system 140 includes an externally threaded adjuster bolt 142, a lock nut 143, an end cover or cap 144, a disk spacer 146A, a wave spring washer 146B, a ring washer 146C, a holder 146D, and a bearing member or bar 146E. The foregoing components are sequentially stacked against an end face 132A of the reel 132 as shown in FIGS. 14 and 15 along a compression axis A-A. The bearing bar 146E is retained in the holder 146D and abuts the end face 132A.

The adjuster bolt 142 is threaded through the lock nut 143 and an internally threaded bore 144A of the end cap 144 such that an end 142B of the adjuster bolt 142 abuts the disk spacer 146A. A socket 142A (e.g., an Allen socket) may be provided in the exposed end of the adjuster bolt 142 to receive a driver to rotate the adjuster bolt 142. The lock nut 143 can be used to secure the position of the adjuster bolt 142 in the bore 144A.

The adjuster bolt 142 can be rotated or driven into the end cap 144 along the axis A-A toward the reel end face 132A to apply a load or force against the end face 132A via the components 146A-E.

In use, the operator can tighten the adjuster bolt 142 to force the bearing bar 146E against the reel end face 132A with a desired load. The friction between the reel end face 132A and the bearing bar 146E thereby applies a selected imposed resistance on the reel 132 that tends to resist rotation of the reel 132 in the unwinding direction U. In this manner, the operator can set the threshold tension as desired. The operator can set the threshold tension to greater than zero tension on the cable 40. According to some embodiments, the wave spring washer 146B is axially compressed to ensure a constant and substantially uniform load on the reel 132.

For example, the imposed resistance on the reel 132 provided by the tension adjustment system 140 can prevent the reel 132 from rotating in the unwinding direction U when a tension load is applied to the reel 132 via the cable 40 but this tension load is insufficient to overcome the imposed resistance. In this instance, the driven larger sprocket 122 will spin freely about the inner sprocket 154 as described above. As a result, the reel 132 will be automatically decoupled from the motor 50 even before the cable 40 is fully unloaded. In particular, the adjustable trigger mechanism 140 may cause the cable slack control mechanism 150 to decouple the reel 132 a short time just prior to the carrier 200 bottoming out. As a result, a positive tension may remain on the cable 40 even when the carrier 200 is fully lowered to the ground (i.e., the cable 40 remains tight).

As discussed above with reference to FIGS. 1 and 6B, the mast system 301 can be configured using the beams 302 and 310 to form the mast assembly 301A having a first, J-shaped configuration. According to some embodiments of the present invention, the mast system 301 includes a further mast beam 320 (FIG. 6C) that can be used with the primary mast beam 302 to form a mast assembly 301B (FIG. 7) having an alternative configuration. The mast beam 320 is generally inverted U-shaped and includes a cross leg 322, a pair of opposed brace legs 324 depending from the cross leg 322, a pair of mast mount brackets 326, and a pair of building mount brackets 328. The mast beam 320 is secured to the primary mast beam 302 by the bracket 326 and is secured to the building 20 by the brackets 328 on the ends of either brace leg 324.

Figure 8:
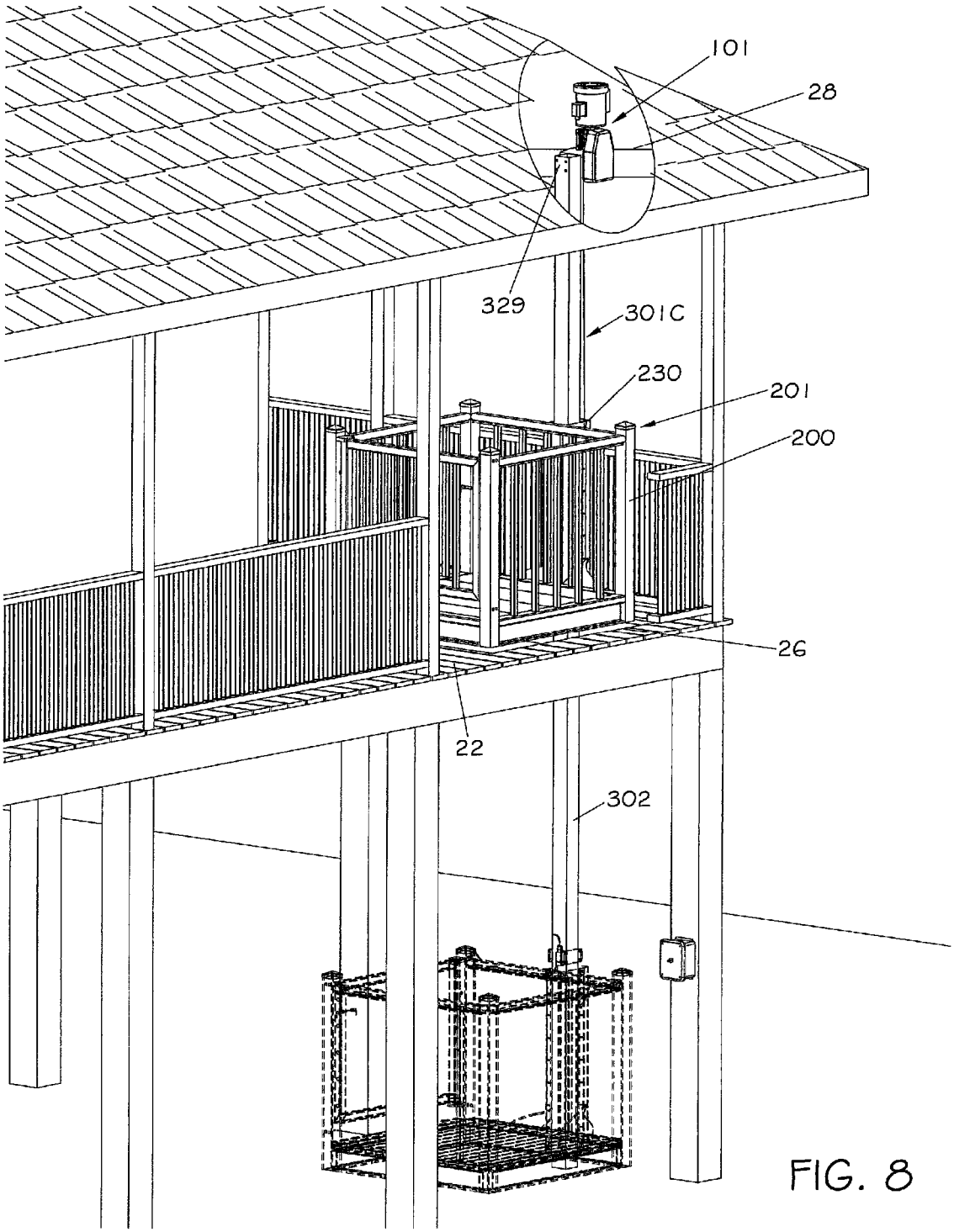
FIG. 8 is a perspective view of the cargo lift system of FIG. 1 mounted on the building structure with an alternative mast arrangement.
Figure 9:
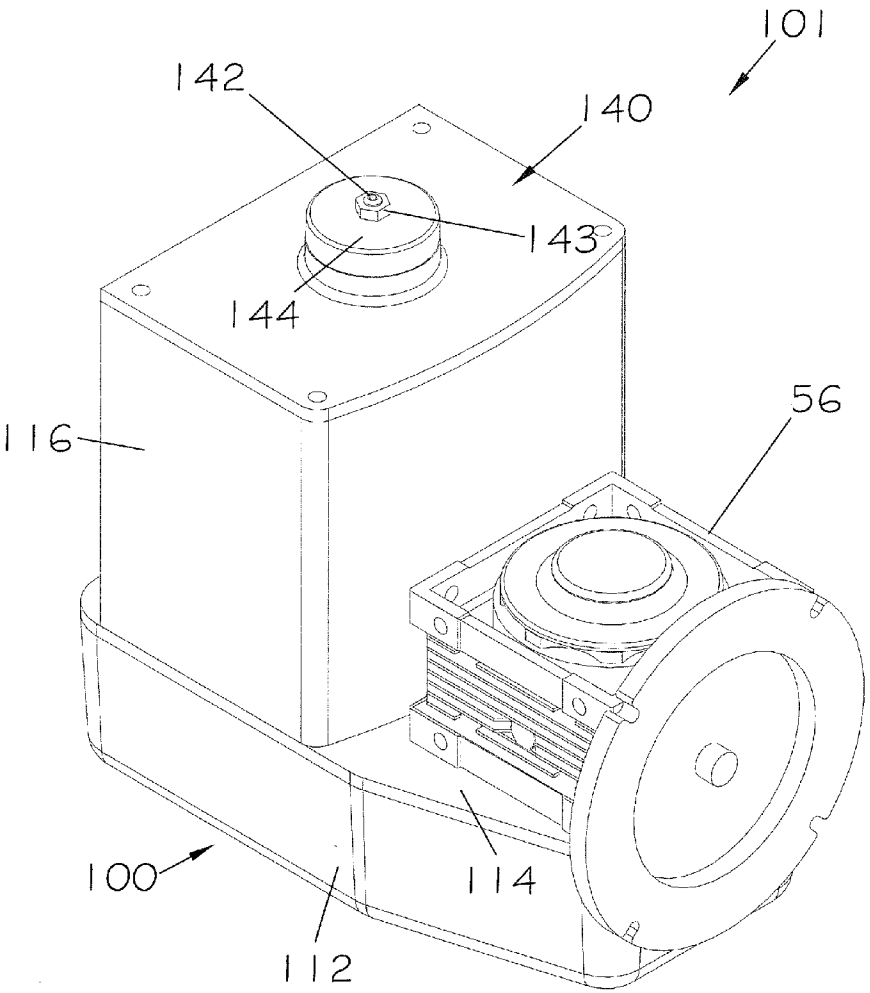
FIG. 9 is an enlarged perspective view of a drive system of the cargo lift system of FIG. 1.

The mast system 301 may be configurable into a mast assembly 301C having a still further alternative configuration as shown in FIG. 8. In the mast assembly 301C, the mast beams 310, 320 are not used and the primary mast beam 302 is instead secured directly (e.g., using a suitable bracket 329 or brackets) to the building 20. The mast assembly 301C may be rafter mounted with the top end of the primary mast beam 302 secured to a rafter 28 overlying the deck 22 by the bracket 329. In this case, an opening 26 may be formed in the deck 22 to permit passage of the carrier 200 therethrough.

The mast beams 302, 310, 320 and the brackets 316, 318, 326, 328, 329 may be formed of any suitable material such as, for example, steel.

While the drive system 101 has been described herein for use with a cargo lift system for raising and lowering a payload relative to a building, drive systems according to embodiments of the present invention (e.g., the drive system 101) may be used in other types of cargo lift systems. According to some embodiments, the drive system 101 including the cable slack control mechanism 150 and the tension adjustment system 140 is used in a boat lift system to raise and lower a cradle configured to hold a boat. Other water-related lift systems are contemplated as well. According to some embodiments, the drive unit is employed with a gangway lift system. A gangway or gangway ramp that is adapted to be lowered into position using a reel and cable system may likewise suffer problems of cable slack if the gangway comes to rest on the bottom G or another impeding structure (e.g. a pier or boat). In accordance with embodiments of the present invention, such a system employs a relief or cable slack control mechanism 150 and a tension adjustment system 140 as described herein.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A drive system for use with a cable and a carrier for raising and lowering a payload between a lower position and an upper position, the carrier being configured to hold the payload, the cable being connected to the carrier, the drive system comprising:

a reel configured to receive the cable, the reel being rotatable in each of a winding direction to wind the cable onto the reel to raise the carrier and an unwinding direction to unwind the cable from the reel to lower the carrier;

a drive mechanism including a drive member and a motor operable to forcibly rotate the drive member in each of a raising direction and a lowering direction, wherein the drive member is operatively connected to the reel to rotate the reel in the winding direction when the drive member is rotated in the raising direction, and to controllably rotate the reel and/or permit the reel to rotate in the unwinding direction when the drive member is rotated in the lowering direction;

a cable slack control mechanism operative to automatically selectively decouple the drive member from the reel while the drive motor is rotating the drive member in the lowering direction when a tension on the cable does not exceed a threshold tension and/or the cable is fully unwound from the reel; and an operator controllable tension adjustment system operable to selectively adjust the threshold tension.

2. The drive system of claim 1 wherein the tension adjustment system is operable to set the threshold tension to greater than zero tension.

3. The drive system of claim 1 wherein the tension adjustment system is operable by the operator to selectively adjust and apply an imposed resistance on the reel to selectively adjust the threshold tension.

4. The drive system of claim 3 wherein the tension adjustment system includes an adjuster bolt arranged and configured to apply the imposed resistance on the reel.

5. The drive system of claim 1 wherein:

the cable slack control mechanism includes at least one tooth and at least one pawl configured to mate with the at least one tooth; and the cable slack control mechanism is configured such that the at least one pawl interlocks with the at least one tooth when the drive member is rotated in the raising direction and permits the at least one tooth to slip with respect to the at least one pawl when the drive member is rotated in the lowering direction while a tension on the cable does not exceed a threshold tension and/or the cable is fully unwound from the reel.

6. The drive system of claim 5 wherein the drive member is a motor output shaft of the motor, and the drive system further includes:

a control sprocket including the at least one tooth, wherein the control sprocket is joined to the reel for rotation therewith;

a driven sprocket; and a drive sprocket operatively connected to the motor output shaft and coupled to the driven sprocket to transfer a drive force from the drive sprocket to the driven sprocket;

wherein the at least one pawl is mounted on the driven sprocket for rotation therewith; and wherein the driven sprocket rotates relative to the reel when the cable slack control mechanism permits the at least one tooth to slip with respect to the at least one pawl.

7. The drive system of claim 6 including a drive chain, wherein the drive sprocket is coupled to the driven sprocket by the drive chain.

8. The drive system of claim 6 including a drive unit housing defining a channel, wherein:

the driven sprocket, the at least one pawl, the control sprocket and the reel are housed in the drive unit housing; and the reel is rotatably mounted in the channel of the drive unit housing.

9. The drive system of claim 1 wherein the motor is a reversible motor.

10. A cargo lift system for raising and lowering a payload between a lower position and an upper position, the cargo lift system comprising:

a carrier configured to hold the payload;

a cable connected to the carrier; and a drive system including:

a reel connected to the cable, the reel being rotatable in each of a winding direction to wind the cable onto the reel to raise the carrier and an unwinding direction to unwind the cable from the reel to lower the carrier;

a drive mechanism including a drive member and a motor operable to forcibly rotate the drive member in each of a raising direction and a lowering direction, wherein the drive member is operatively connected to the reel to rotate the reel in the winding direction when the drive member is rotated in the raising direction, and to controllably rotate the reel and/or permit the reel to rotate in the unwinding direction when the drive member is rotated in the lowering direction;

a cable slack control mechanism operative to automatically selectively decouple the drive member from the reel while the drive motor is rotating the drive member in the lowering direction when a tension on the cable does not exceed a threshold tension and/or the cable is fully unwound from the reel; and an operator controllable tension adjustment system operable to selectively adjust the threshold tension.

11. A cargo lift system for raising and lowering a payload between a lower position and an upper position adjacent a support structure, the cargo lift system comprising:

a mast system including:

a primary mast beam;

a plurality of mounting beams selectively configurable in a plurality of alternative configurations to secure the primary mast beam to the support structure;

a carrier configured to hold the payload;

a sleeve housing defining a sleeve housing passage, wherein the sleeve housing is secured to the carrier and is slidably mounted on the primary mast beam such that the primary mast beam extends through the sleeve housing passage;

a cable connected to the sleeve housing; and a drive system including:

a reel connected to the cable, the reel being rotatable in each of a winding direction to wind the cable onto the reel to raise the carrier along the primary mast beam and an unwinding direction to unwind the cable from the reel to lower the carrier along the primary mast beam; and a drive mechanism including a motor operable to forcibly rotate the reel in each of the winding direction and the unwinding direction;

wherein the mast system is configured to mount the primary mast beam to the support structure in at least two of a first mount configuration, a second mount configuration and a third mount configuration, wherein:

in the first mount configuration, the primary mast beam is directly secured to the support structure without use of any of the plurality of mounting beams;

in the second mount configuration, the primary mast beam is not directly secured to the support structure and is indirectly secured to the support structure by only one of the plurality of mounting beams; and in the third mount configuration, the primary mast beam is not directly secured to the support structure and is indirectly secured to the support structure by two of the plurality of mounting beams.

12. The cargo lift system of claim 11 wherein the sleeve housing assembly includes a plurality of separately formed sleeve housing members fastened together to form the sleeve housing, wherein the sleeve housing members are substantially J-shaped in horizontal cross-section.

* * * * *